US005664358A

United States Patent [19]

Haber et al.

[11] Patent Number: 5,664,358

[45] Date of Patent: Sep. 9, 1997

[54] BARREL LOCK FOR A HAND GUN

[75] Inventors: Terry M. Haber, El Toro; William H. Smedley, Lake Elsinore; Clark B. Foster, Laguna Niguel, all of Calif.

[73] Assignee: Habley Medical Technology Corporation, Lake Forest, Calif.

[21] Appl. No.: 613,885

[22] Filed: Mar. 11, 1996

[51] Int. Cl.[6] ..... F41A 17/00

[52] U.S. Cl. ..... 42/70.11; 42/44

[58] Field of Search ..... 42/70.11, 44; 89/168

[56] References Cited

U.S. PATENT DOCUMENTS

| | | | |
|---|---|---|---|
| 3,720,014 | 3/1973 | Goodrich | 42/1 N |
| 3,768,189 | 10/1973 | Goodrich | 42/1 N |
| 4,398,366 | 8/1983 | Wernicki | 42/1 LP |
| 4,512,099 | 4/1985 | Mathew | 42/1 LP |
| 5,052,142 | 10/1991 | Mikus | 42/70.11 |
| 5,054,223 | 10/1991 | Lee | 42/70.11 |
| 5,241,770 | 9/1993 | Lambert | 42/70.11 |
| 5,398,438 | 3/1995 | Williams | 42/70.11 |

*Primary Examiner*—Charles T. Jordan
*Assistant Examiner*—Meena Chelliah
*Attorney, Agent, or Firm*—Morland C. Fischer

[57] ABSTRACT

Disclosed is a barrel lock to be removably inserted and reliably locked within the barrel of a hand gun to prevent the accidental and unauthorized firing of the hand gun without requiring any manufacturing changes to the gun. The barrel lock includes an expandable chamber lock that is located at the distal end of a barrel lock tube. The barrel lock tube is adapted to slide inwardly through the gun barrel to locate the chamber lock to be received in and retained at the existing bullet chamber of the gun barrel, whereby the hand gun is disabled. A combination lock cooperates with the proximal end of the barrel lock tube to prevent the barrel lock tube from being withdrawn from the gun barrel and the chamber lock from being removed from the bullet chamber until a particular predetermined combination has first been successfully dialed in.

8 Claims, 6 Drawing Sheets

BARREL LOCK FOR A HAND GUN

BACKGROUND OF THE INVENTION

1. Field of the Invention

This invention relates to a barrel lock having a combination lock associated therewith, whereby the bared lock may be removably inserted and reliably locked within the barrel of a hand gun to prevent the accidental and unauthorized firing of the hand gun without requiring any manufacturing changes to the gun.

2. Background Art

The careless handling and/or storage and/or unauthorized use of a firearm (e.g. a hand gun) is known to result in many serious injuries and deaths. Young children who gain access to a loaded hand gun in their own home without the knowledge or supervision of an adult are particularly susceptible to inflicting life threatening wounds to themselves and others around them. In many cases, hand gun owners have attempted to either hide their guns or lock their guns away in cabinets, drawers, etc. However, these efforts have proven to be largely unsuccessful, because unsuspecting children are often able to find the hand guns and the ammunition to be loaded therein. Moreover, the gun owner sometimes forgets to unload his gun or to lock the cabinet or drawer in which his gun is placed, or he carelessly leaves the keys in easy sight of an individual not authorized to use the gun or not sufficiently trained in proper safety methods.

In an attempt to overcome the problems inherent with the aforementioned efforts at child-proofing or locking away hand guns to prevent their accidental and unauthorized firing, various locking mechanisms have been introduced to disable the gun. However, such locking mechanisms usually require that the gun be modified which typically increases the manufacturing costs. In these cases, gun manufacturers have generally declined to change the way their hand guns are made for the sole purpose of accommodating any or all of the locking mechanisms.

Another proposed solution to preventing the accidental and unauthorized firing of a hand gun is a trigger lock that requires no modification to the hand gun. A common problem with such trigger lock is that a key must be used to remove the lock. In some cases, the key may be misplaced or lost. In emergency situations, a ready access to the key may not be possible. Consequently, many locking mechanisms have gone unused, thereby exposing hand gun owners to the risk of unsafe and potentially life-threatening situations wherever hand guns are stored and whenever hand guns fall into the hands of children and those who do not have suitable skill or exercise proper safety habits around guns.

Examples of conventional locking mechanisms that are interlocked with a hand gun to prevent the unauthorized use thereof are available by referring to one or more of the following U.S. patents:

| | |
|---|---|
| 4,384,420 | May 24, 1983 |
| 4,532,729 | August 6, 1985 |
| 4,761,906 | August 9, 1988 |
| 4,763,431 | August 16, 1988 |
| 4,987,693 | January 29, 1991 |
| 5,140,766 | August 25, 1992 |
| 5,229,532 | July 20, 1993 |
| 5,233,777 | August 10, 1993 |
| 5,457,907 | October 17, 1995 |

SUMMARY OF THE INVENTION

This invention relates to a barrel lock to be removably inserted and reliably locked within the barrel of any hand gun to prevent the accidental and unauthorized firing of the gun. The barrel lock of this invention may be used without requiring that any modification be made to the hand gun in which it is used. Moreover, no special skill or keys are necessary to install, lock or remove the barrel lock.

The barrel lock includes a hollow, cylindrical barrel lock housing that is disposed within a tumbler housing. A hollow, elongated barrel lock tube extends from the barrel lock housing and projects outwardly from the tumbler housing. A relatively wide chamber lock is located at the proximal end of the barrel lock tube. The barrel lock tube is manufactured from a flexible material, and the chamber lock has a plurality of longitudinal slots running therethrough so that the chamber lock is adapted to expand under stress. The hollow barrel lock tube surrounds a barrel lock rod. The distal end of the barrel lock rod is connected to an expansion mandrel, and the proximal end of the rod is connected to an end plug. In the at-rest condition of the barrel lock, the expansion mandrel is enclosed by the chamber lock of the barrel lock tube so as to exert a radially outward force for causing the chamber lock to expand to an increased diameter. In the insertion/removal condition of the barrel lock, the barrel lock rod is slidable through the barrel lock tube for causing the expansion mandrel to be displaced distally and outwardly from the chamber lock for allowing the chamber lock to contract to a reduced diameter.

A combination lock shaft is supported for reciprocal movement through the tumbler housing. Located at the distal end of the lock shaft is a disk-like ram face that abuts the end plug of the barrel lock rod inside the tumbler housing. A barrel insertion knob is connected to the proximal end of the lock shaft. In the at-rest condition of the barrel lock, the barrel insertion knob is disposed outwardly from a passageway at the proximal end of the tumbler housing. In the insertion/removal condition of the barrel lock, a distal pushing force is applied to the barrel insertion knob for moving the knob axially through the passageway and into the tumbler housing such that a corresponding pushing force is applied to the expansion mandrel via the lock shaft, the ram face of the lock shaft, the end plug of the barrel lock rod and the lock rod. Accordingly, the expansion mandrel connected to the lock rod will be displaced outwardly and distally relative to the chamber lock of the barrel lock tube.

A plurality of rotatable tumbler wheels, common to a conventional combination lock, are mounted on respective keyway cores, and the cores surround the combination lock shaft. Each of the tumbler wheels represents a digit of a predetermined combination which must be successfully dialed in to deploy the barrel lock from the at-rest condition to the insertion/removal condition. The tumbler wheels are accessible through an access opening in the tumbler housing so that the wheels may be selectively rotated by the user. Provided that the combination is successfully dialed in at the tumbler wheels, the combination lock shaft can be moved through the keyway cores and into the barrel lock housing in response to a distal pushing force against the barrel insertion knob. However, if the combination is not successfully dialed in, then the lock shaft will be blocked from moving through the keyway cores and into the barrel lock housing.

To deploy the barrel lock in the installation/removal condition, the user first enters the predetermined combination at the tumbler wheels to free the combination lock shaft for reciprocal movement. A distal pushing force is then applied to the barrel insertion knob for causing the lock shaft to move through the tumbler housing and the barrel lock rod to move through the barrel lock tube. Accordingly, the expansion mandrel is displaced distally from the chamber lock which contracts to a reduced diameter that is suitable to permit the barrel lock tube to be inserted through the barrel of a hand gun. When the barrel lock reaches the existing, relatively wide bullet chamber of the gun barrel, the chamber lock automatically expands and the expansion mandrel will be retracted proximally within the chamber lock by means of expanding springs so as to maintain the increased diameter of the chamber lock. With the chamber lock filling the bullet chamber, the barrel lock is returned to its at-rest condition at which to be reliably secured within the barrel of the hand gun, whereby the gun is now disabled and rendered safe for handling and storage. The barrel lock is removed from the hand gun while deployed in the insertion/removal condition by repeating the aforementioned steps and pulling the barrel lock tube out of the barrel.

DETAILED DESCRIPTION

Figure 1:
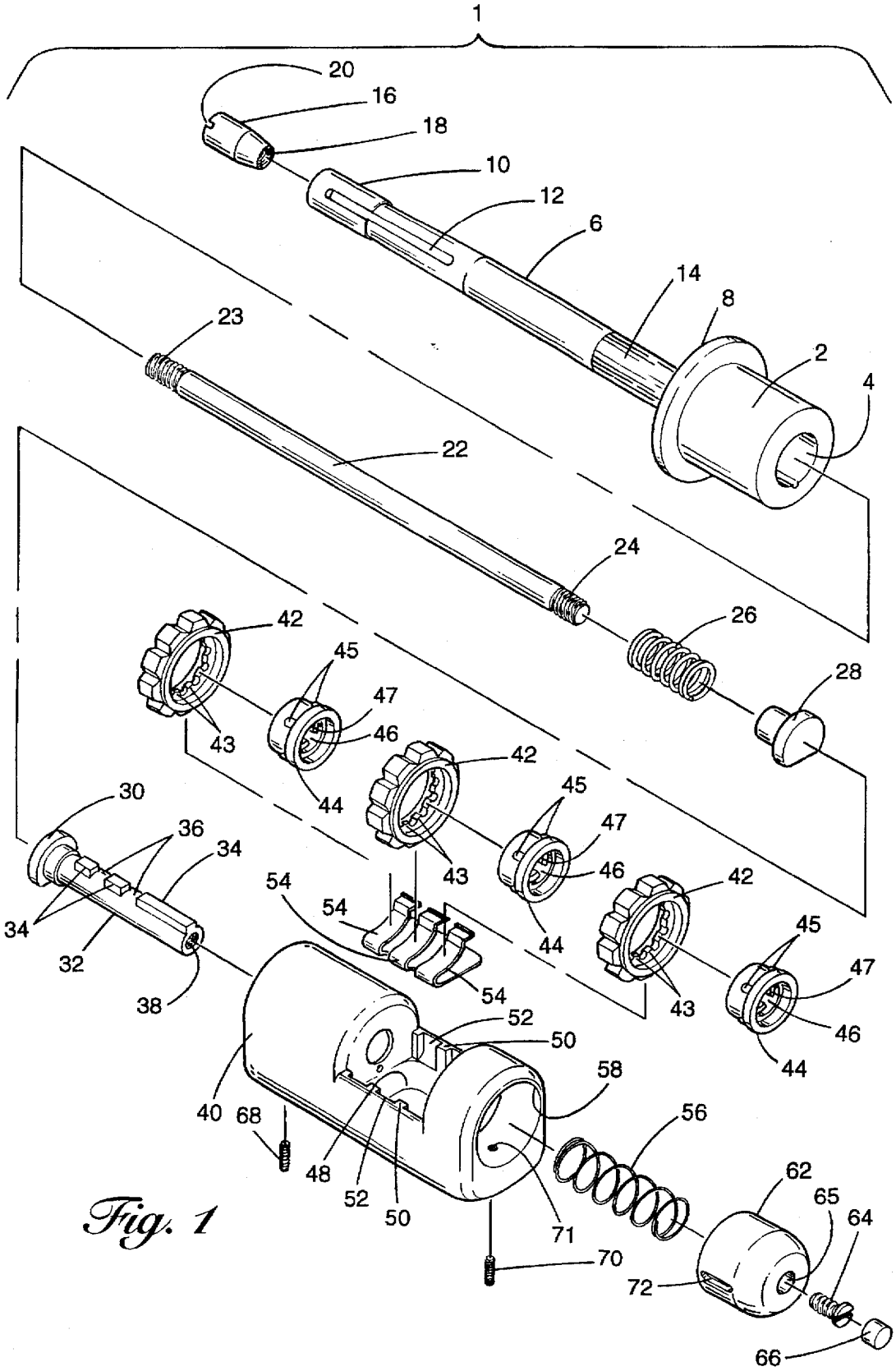
FIG. 1 is an exploded view of the barrel lock for a hand gun which forms the present invention.
Figure 2:
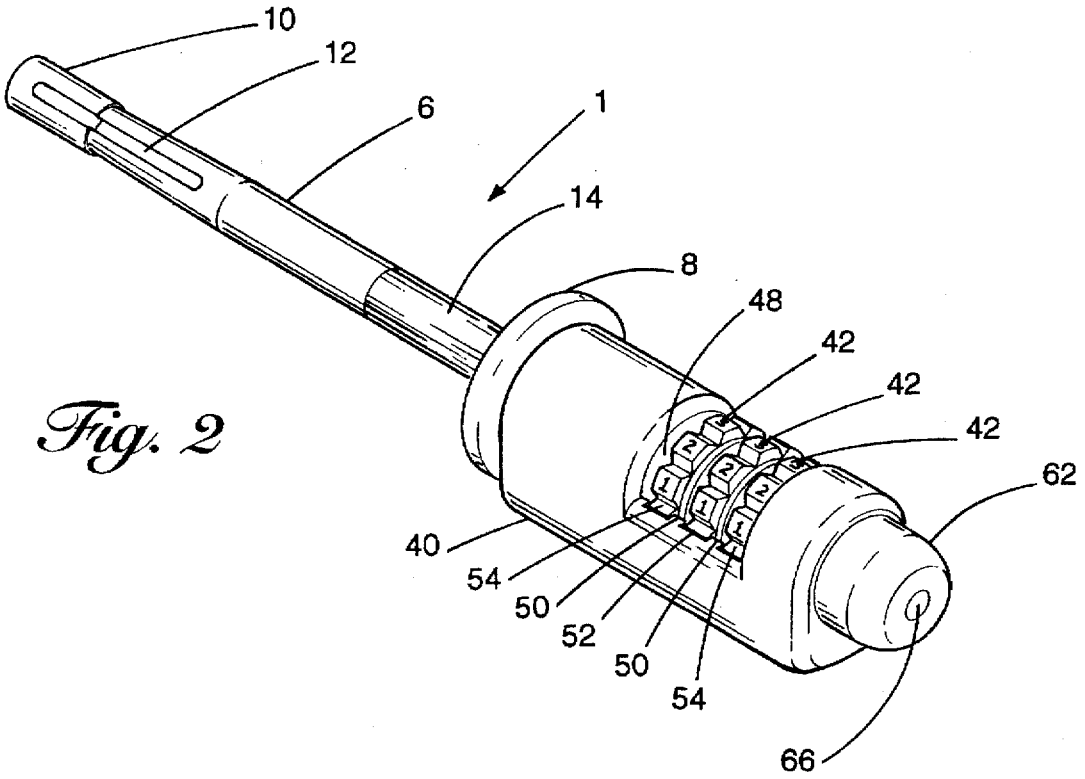
FIG. 2 shows the barrel lock of FIG. 1 in an assembled configuration.

The barrel lock which forms the present invention is best described while referring to the drawings, where FIGS. 1 and 2 show the barrel lock 1 in respective exploded and assembled, ready to install configurations. Barrel lock 1 includes a cylindrical housing 2 having a hollow interior 4. Projecting distally from the barrel lock housing 2 is a co-extensively formed hollow barrel lock tube 6. As will soon be explained, an elongated barrel lock rod 22 is located within and slidable reciprocally through the hollow barrel lock tube 6 for receipt at the hollow interior 4 of barrel lock housing 2 at which reciprocal pushing and pulling forces can be applied to rod 22 for an important purpose that will be disclosed hereinafter. A disk-like finger ledge 8 surrounds the distal end of barrel lock housing 2 at the interface of the barrel lock tube 6 with housing 2.

Located at the distal end of the barrel lock tube 6 is a relatively wide, integrally formed chamber lock 10. Chamber lock 10 has a slightly larger diameter than the remaining length of tube 6. As an important aspect of this invention, the hollow barrel lock tube 6 projecting from barrel lock housing 2 is manufactured from a flexible (e.g. plastic) material to facilitate the ability of the chamber lock 10 thereof to flex (e.g. expand) under stress. However, the chamber lock 10 of barrel lock tube 6 is normally contracted absent an expansive force. A plurality of short, longitudinally extending expansion slots 12 (only one of which being visible in FIGS. 1 and 2) runs through a majority of the chamber lock 10 but terminates just prior to the distal end of tube 6. As will soon be disclosed, it is the expansion and contraction of the chamber lock 10 of barrel lock tube 6 that enables the barrel lock 1 of this invention to be easily and quickly installed and locked within the barrel of a hand gun. A "red flag" area 14 that is typically colored red or some other bright color is visible around the proximal end of the barrel lock tube 6 adjacent the finger ledge 8. The advantage of red flag area 14 of tube 6 will be described hereinafter.

Figure 3:
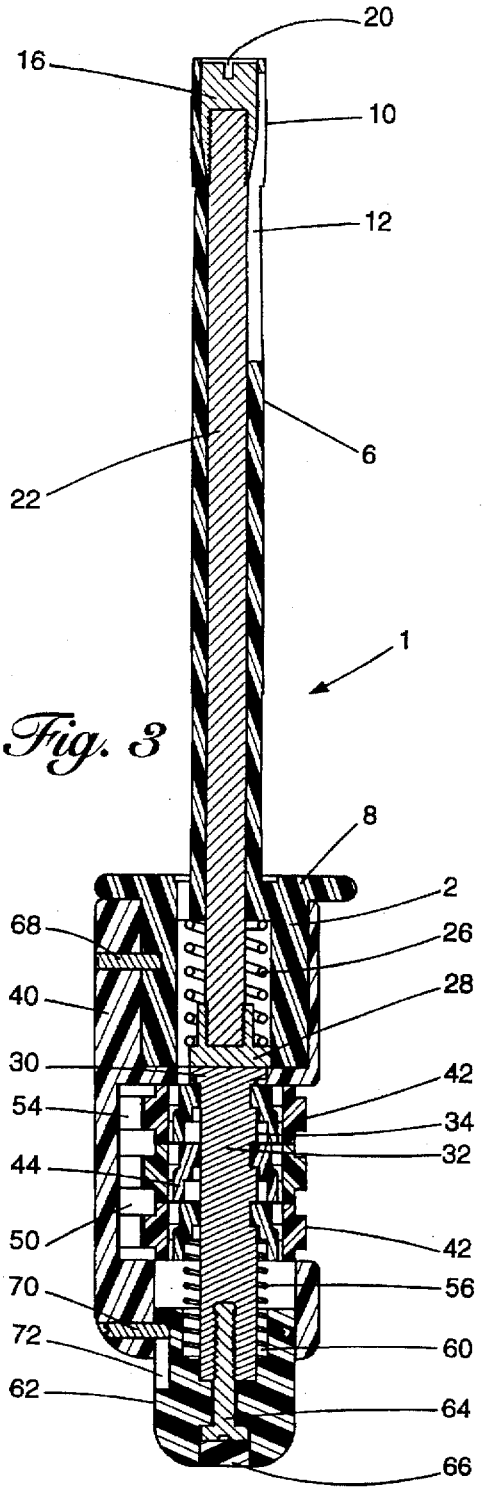
FIG. 3 is a cross-section of the barrel lock of FIG. 2 in the at-rest condition.

A (e.g. metallic) expansion mandrel 16 is sized so that in the at-rest condition of the barrel lock 1, the mandrel 16 will fit snugly within and be surrounded by the chamber lock 10 at the distal end of barrel lock tube 6 (best shown in FIG. 3). Expansion mandrel 16 has a hollow screw threaded first end 18 to enable mandrel 16 to be mated to a corresponding screw threaded end 23 of the aforementioned barrel lock rod 22 that extends inside the barrel lock tube 6. In this manner, the reciprocal movement of barrel lock rod 22 will be transmitted to the expansion mandrel 16 mated thereto, whereby to cause the mandrel 16 to be displaced relative to the chamber lock 10 when the barrel lock 1 is installed in or removed from a hand gun. A slot 20 is formed at the opposite end of expansion mandrel 16 to receive a suitable tool (e.g. a screwdriver) to facilitate the connection of mandrel 16 to barrel lock rod 22 at the respective threaded ends 18 and 23 thereof.

The barrel lock rod 22 has opposing distal and proximal screw threaded ends 23 and 24. As earlier disclosed, the barrel lock rod 22 is located within and slidable reciprocally through the barrel lock tube 6 to impart corresponding reciprocal movements to the expansion mandrel 16 relative to the chamber lock 10 which surrounds mandrel 16 at the distal end of tube 6. Barrel lock rod 22 is of sufficient length to extend (in the at-rest condition of the barrel lock 1 shown at FIG. 3) from the distal end of barrel lock tube 6 (at which the threaded distal end 23 of rod 22 is mated to the threaded end 18 of expansion mandrel 16) to the hollow interior 4 of barrel lock housing 2 (at which the threaded proximal end 24 of rod 22 is interfaced with means for applying reciprocal pushing and pulling forces for causing the rod 22 to slide through the barrel lock tube 6 and the expansion mandrel 16 to be displaced relative to the chamber lock 10).

More particularly, a coil spring 26 is located within the interior 4 of barrel lock housing 2 so as to surround the proximal end of the barrel lock rod 22. An end plug 28 having a screw threaded body is also located within the interior 4 of housing 2 and mated to the threaded proximal end 24 of barrel lock rod 22. In this case, the coil spring 26 (in the at-rest condition of barrel lock 1 as shown in FIG. 3) lies in a relaxed, expanded state between the end plug 28 and an opposing end wall at the interior 4 of barrel lock housing 2.

An axial pushing force is transmitted to the barrel lock rod 22 via the end plug 28 connected at the proximal end thereof by a ram face 30 of a tubular combination lock shaft 32. In the assembled barrel locking configuration of FIG. 2, the ram face 30 of lock shaft 32 is disposed flush against end plug 28. During installation and removal of the barrel lock 1 in and from the barrel of a hand gun (as best shown in FIG. 4), the lock shaft 32 is adapted to move distally through the hollow interior 4 of barrel lock housing 2 so as to cause the ram face 30 thereof to drive end plug 28 through the housing 2 and against the normal (i.e. expanded) bias of coil spring 26.

Figure 4:
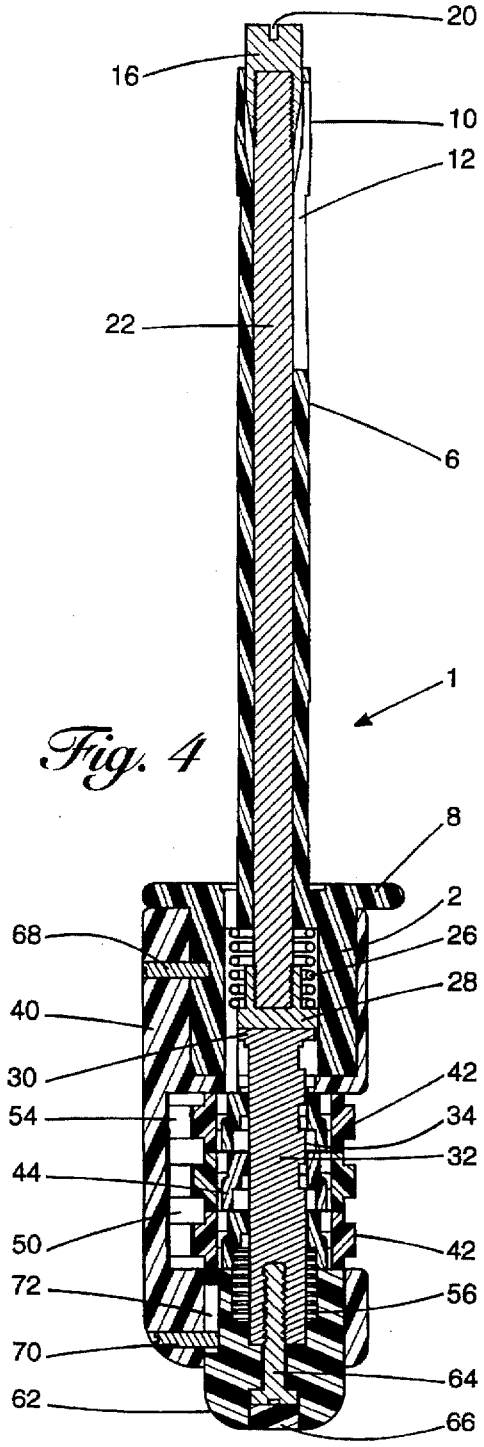
FIG. 4 is a cross-section of the barrel lock of FIG. 2 in the insertion/removal condition.

The lock shaft 32 extends from the ram face 30 at the interior 4 of barrel lock housing 2, through a soon-to-be-described tumbler housing 40, to be connected to a barrel insertion knob 62 (best shown in FIGS. 3 and 4). Running along the lock shaft 32 is a series of longitudinally aligned rails 34 that are spaced from one another by interposed keyways 36. The number of rails 34 will depend upon the number of digits used to set a combination, the knowledge of which is required to operate the barrel lock 1 of this invention. A screw threaded opening 38 is formed at the proximal end of combination lock shaft 32.

The barrel lock 1 includes the aforementioned tumbler housing 40 that carries a combination lock which must be successfully manipulated to match a predetermined multi-digit combination before barrel lock 1 can be removed from the barrel of a hand gun to permit the gun to be fired. Similar to conventional combination locks, the combination lock used in the present invention includes a plurality of (e.g. plastic) tumbler wheels 42, each wheel having the usual numbered faces extending around the outer periphery thereof and tumbler cogs 43 spaced from one another around the inside periphery. While three tumbler wheels 42 are illustrated, this is for the purpose of example only, and any number of wheels 42 may be used herein depending upon the number of digits that forms the combination.

In the assembled barrel lock configuration of FIG. 2, the tumbler wheels 42 are mounted on and rotatable with respective (e.g. plastic) keyway cores 44. Each keyway core 44 is hollow and includes a set of external dogs 45 that are spaced from one another and adapted to be received at the spaces between the cogs 43 at the inside of the tumbler wheels 42 so that a rotation of any wheel 42 when a combination is dialed in is imparted to the core 44 upon which said wheel is mounted. Each keyway core 44 also includes an internal slot 46 that extends longitudinally through an internal ledge 47 and is sized to accommodate therepast the longitudinally aligned rails 34 from the lock shaft 32.

In cases when the tumbler wheels 42 are rotated and the predetermined combination is successfully dialed in, the keyway cores 44 will be positioned to permit the series of longitudinally aligned rails 34 to move through the slots 46. In cases when any tumbler wheel 42 is rotated out of the predetermined combination, passage of the rails 34 will be blocked by the internal ledge 47 of a corresponding keyway core 44 being rotated into a keyway 36 between a pair of successive rails 34.

The tumbler wheels 42 are mounted on the keyway cores 42, and the keyway cores 42 surround the lock shaft 32 so that the tumbler wheels 42 are arranged in parallel, side-by-side alignment and accessible through an access opening 48 in the tumbler housing 40 (best shown in FIG. 2). A series of tumbler guide ribs 50 that are disposed along the access opening 48 of tumbler housing 40 have guide wells 52 formed therebetween so as to receive respective ones of the tumbler wheels 42. A corresponding number of leaf-type tumbler indexing springs 54 are located within respective guide wells 52 to be pressed into engagement with and retain the tumbler wheels 42 at the positions to which wheels 42 have been rotated to dial in a particular combination.

The side-by-side alignment of the tumbler wheels 42 in the guide wells 52 of tumbler housing 40 is preserved by a helically wound coil spring 56 that presses against the series of keyway cores 44. One end of coil spring 56 is received through a passageway 58 at the proximal end of tumbler housing 40 to be accommodated against the ledge 47 at the interior of the proximal-most keyway core 44 surrounding the lock shaft 32. The opposite end of spring 56 is received within a pocket (designated 60 in FIGS. 3 and 4) formed in the barrel insertion knob 62. In the at rest condition of barrel lock 1 shown in FIG. 3, the coil spring 56 lies in a relaxed (i.e. expanded) state between keyway core 44 and the barrel insertion knob 62. The barrel insertion knob 62 is affixed to the lock shaft 32 by way of an attachment screw 64 that is counter-sunk inside a screw hole 65 so that screw 64 is mated to the threaded opening 38 at the proximal end of lock shaft 32. The screw hole 65 through barrel insertion knob 62 is filled by a suitably sized plug 66.

A first set screw 68 is inserted upwardly through a screw hole in the distal end of tumbler housing 40 (best shown in FIGS. 3 and 4) to fixedly connect the tumbler housing 40 to the barrel lock housing 2. A second set screw 70 is inserted upwardly through a screw hole 71 in the proximal end of housing 40 to be received in a guide slot 72 of the barrel insertion knob 62. The guide slot 72 runs axially and partially along the outside of barrel insertion knob 62 so that when the barrel lock 1 is operated from the at-rest condition of FIG. 3 to the insertion/removal condition of FIG. 4, the location of the barrel insertion knob 62 will change relative to tumbler housing 40 and the location of the guide slot 72 will change by an identical amount relative to the set screw 70.

That is to say, and as will soon be disclosed in greater detail, an axial pushing force is applied to the ram face 30 of lock shaft 32 to cause a corresponding distal movement of barrel lock rod 22 through the barrel lock tube 6 and a displacement of the expansion mandrel 16 relative to the chamber lock 10 of tube 6. This axial pushing force is generated when the barrel insertion knob 62 is pressed inwardly and distally through the passageway 58 at the proximal end of tumbler housing 40. In this case, the normally expanded coil spring 56 will be compressed between the proximal-most keyway core 46 and the barrel insertion knob 62 at the same time that the guide slot 72 of insertion knob 62 slides over the set screw 70 (best shown in FIG. 4).

The operation of the barrel lock 1 of this invention is now described while referring to FIGS. 3–9. FIG. 3 of the drawings shows the barrel lock in the at-rest condition. Barrel lock 1 will be at rest when it is removed from the barrel of a hand gun for storage and when it is installed and locked within the barrel to prevent the hand gun from being fired by an unauthorized individual (in the manner best shown in FIG. 9). In this regard, the springs 26 and 56 are in their normally relaxed, expanded state. Therefore, the barrel insertion knob 62 is positioned outwardly from the tumbler housing 4 and spaced distally from the keyway cores 44 upon which tumbler wheels 42 are mounted, and the set screw 70 projects upwardly through housing 40 for receipt at the distal end of the guide slot 72 in knob 62. The end plug 28 adjacent the ram face 30 of lock shaft 32 is urged (by spring 26) to the proximal end of the interior 4 of lock barrel housing 2, and the barrel lock rod 22 is retracted proximally and inwardly of the barrel lock tube 6 so as to be completely surrounded thereby.

It is important to note that while barrel lock 1 is at rest, the expansion mandrel 16 connected to the distal end of the barrel lock rod 22 is enclosed by the chamber lock 10 located at the distal end of the barrel lock tube 6. In this case, the mandrel 16 exerts a radially outward expansive force on the chamber lock 10, whereby chamber lock 10 is stressed and, by virtue of expansion slots 12, is expanded (i.e. the diameter thereof is increased). In this same regard, the relatively wide chamber lock 10 prevents the barrel lock 1 from being inserted into the barrel of a handgun while barrel lock 1 is at rest.

With barrel lock 1 at rest, as shown in FIG. 3, the tumbler wheels 42 are typically rotated away from the unique combination that is required to activate the barrel lock 1 for deployment in the insertion/removal condition of FIG. 4.

That is, the keyway cores 44 are correspondingly rotated by respective tumbler wheels 42 so that the internal slots 46 of the keyway cores 44 (best shown in FIG. 1) are moved out of alignment with the rails 34 of lock shaft 32. Accordingly, the internal ledges 47 of cores 44 are received within respective keyways 36 of lock shaft 32 to block the axial displacement of shaft 32 through the keyway cores 44 and distally through the tumbler housing 40. As will soon become apparent, the barrel lock 1 is now locked against being inserted into or removed from the barrel lock of a hand gun.

Referring now to FIG. 4 of the drawings, in order to unlock the barrel lock 1 from the at-rest condition for deployment in the insertion/removal condition so that barrel lock 1 may be inserted into or removed from the barrel of a hand gun, the user must first successfully dial in the predetermined combination by rotating the tumbler wheels 42 and the respective keyway cores 44 upon which wheels 42 are mounted so that the internal slots 46 of cores 44 are axially aligned with the rails 34 of lock shaft 32. In this case, the rails 34 of lock shaft 32 are permitted to pass through the keyway cores 44 via internal slots 46 so that the shaft 32 may be displaced distally through the tumbler housing 40.

To activate barrel lock 1 to the insertion/removal condition of FIG. 4, an axial (i.e. distal) pushing force is applied to the barrel insertion knob 72, whereby knob 72 is moved inwardly of the tumbler housing 40 towards the keyway cores 44, and guide slot 72 travels past set screw 70 until the screw 72 is located at the proximal end thereof. The movement of barrel insertion knob 62 into housing 40 causes the coil spring 56 to be compressed between the proximal-most keyway core 44 and the pocket 60 of knob 62 within which the spring 56 is received. The movement of barrel insertion knob 62 is also transmitted to the lock shaft 32 which is now free to move distally through the tumbler housing 40 and into the interior 4 of barrel lock housing 2, whereby the ram face 30 of shaft 32 exerts a corresponding axial pushing force against the end plug 28 connected to barrel lock rod 22.

Accordingly, the barrel lock rod 22 is pushed distally through the barrel lock tube 6, and the coil spring 26 is compressed between the distal end wall at the interior 4 of barrel lock housing 2 and the end plug 28 at the proximal end of barrel lock rod 22. In this same regard, the expansion mandrel 16 connected to the distal end of rod 22 is advanced distally and outwardly from the normally contracted chamber lock 10 of barrel lock tube 6. In this case, and by virtue of its spring-like memory and the expansion slots 12, the chamber lock 10 will automatically contract (i.e. the diameter thereof is reduced).

Figure 5:
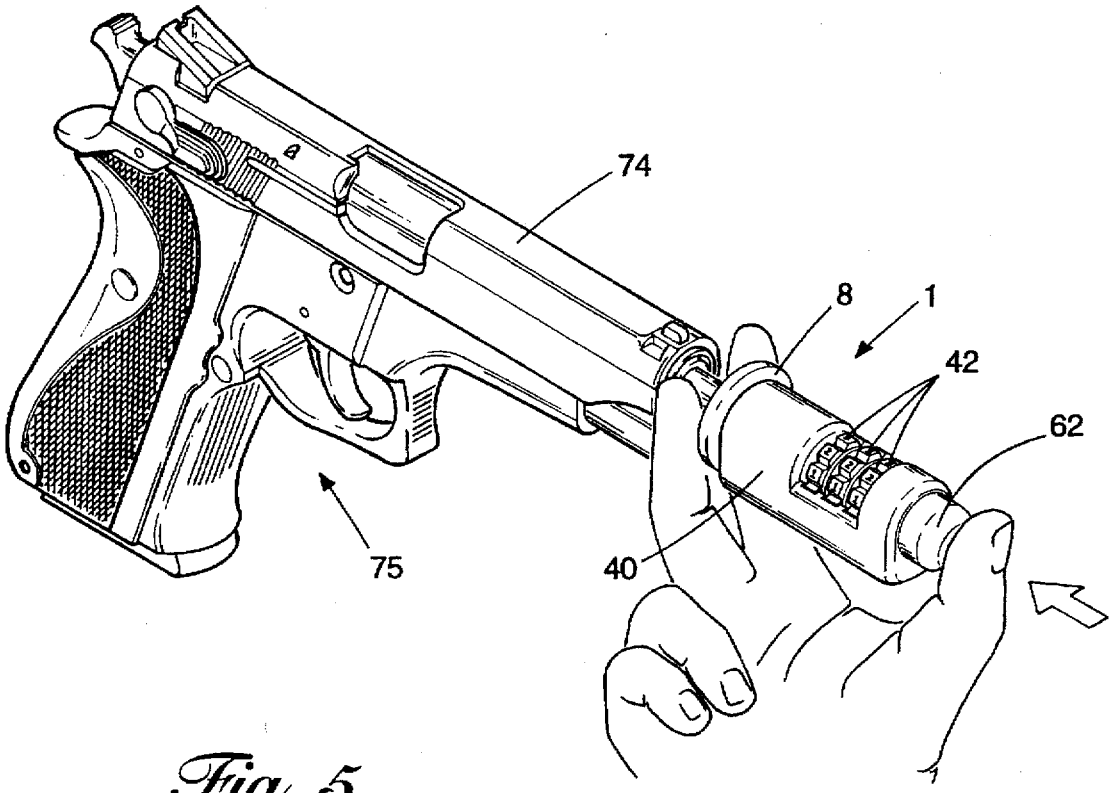
FIGS. 5–7 illustrate the steps for inserting the barrel lock into the barrel of a hand gun.
Figure 6:
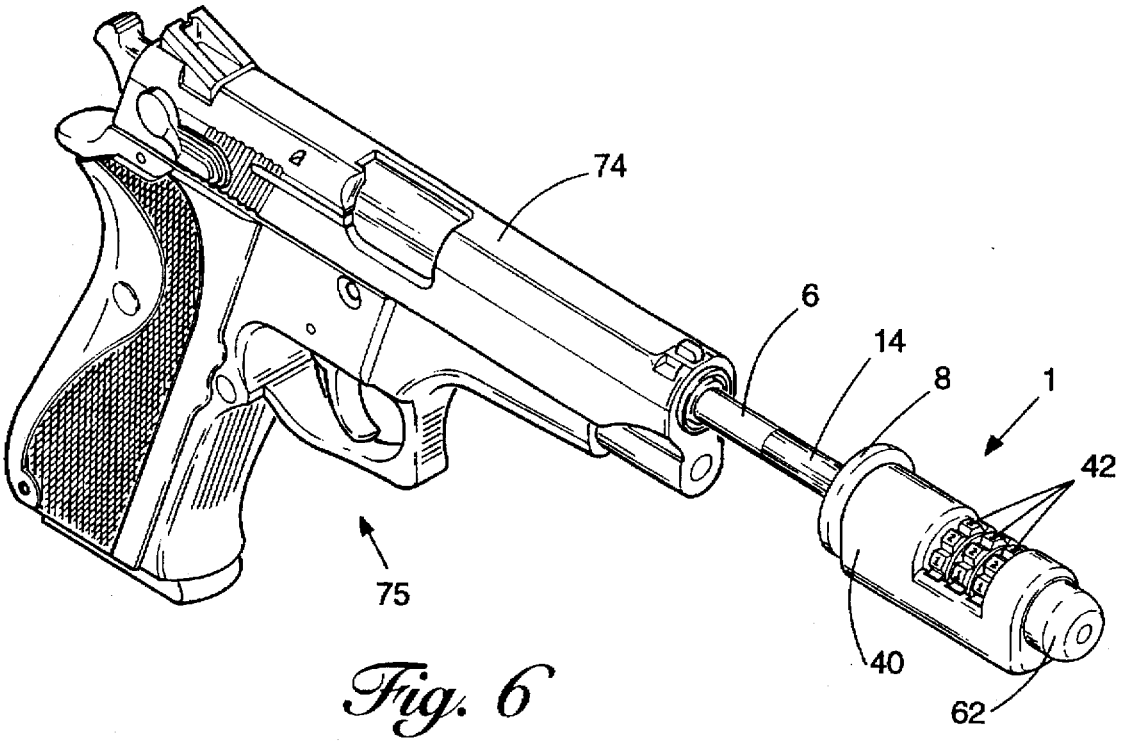
Figure 7:
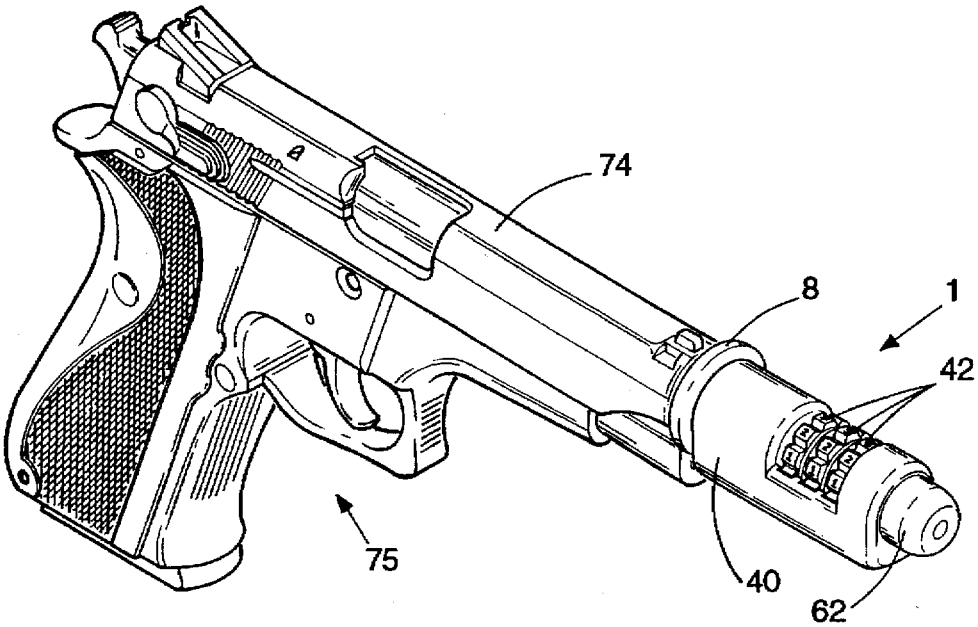

FIGS. 5–7 of the drawings illustrate the steps for inserting the barrel lock 1 of this invention into the barrel 74 of a hand gun 75 so as to prevent the gun from being fired by an unauthorized individual. Initially, the user locates his index and middle fingers against the finger ledge 8 of the barrel lock housing 2 (best shown in FIG. 5). While supporting the barrel lock tube 6 between his fingers, the user uses his thumb to apply an axial (i.e. distal) pushing force to the barrel insertion knob 62. Provided that the predetermined combination has been correctly dialed in at the tumbler wheels 42, the axial pushing force applied to knob 62 is transferred to the barrel lock rod 22 by way of the lock shaft 32, the ram face 30 of shaft 32, and the end plug 28 of rod 22. That is, and as was earlier disclosed when referring to FIG. 4, the lock shaft 32 moves distally through the tumbler housing 40 to impart a corresponding distal displacement to the barrel lock rod 22 relative to the barrel lock tube 6.

Accordingly, and as was also earlier disclosed, the expansion mandrel 16 is displaced distally and outwardly from the chamber lock 10 connected to barrel lock tube 6 so as to permit chamber lock 10 to automatically contact. In its contracted configuration, the chamber lock 10 is of reduced diameter to permit the chamber lock 10 and the barrel lock tube 6 to slide inwardly through the barrel 74 of the hand gun 75 after the user's thumb and fingers have been removed from the barrel lock 1 (best shown in FIGS. 6 and 7). However, should there be a bullet accidentally remaining in the firing chamber of hand gun 75, then the complete insertion of the tube 6 through gun barrel 74 will be blocked by the presence of the bullet. In this case, the red flag area 14 of the barrel lock tube 6 will be visible outside the gun barrel 74 so as to immediately alert the user that there is an obstruction (e.g. a bullet) therewithin. Thus, the user can then remove the bullet before the gun 75 is locked.

Figure 8:
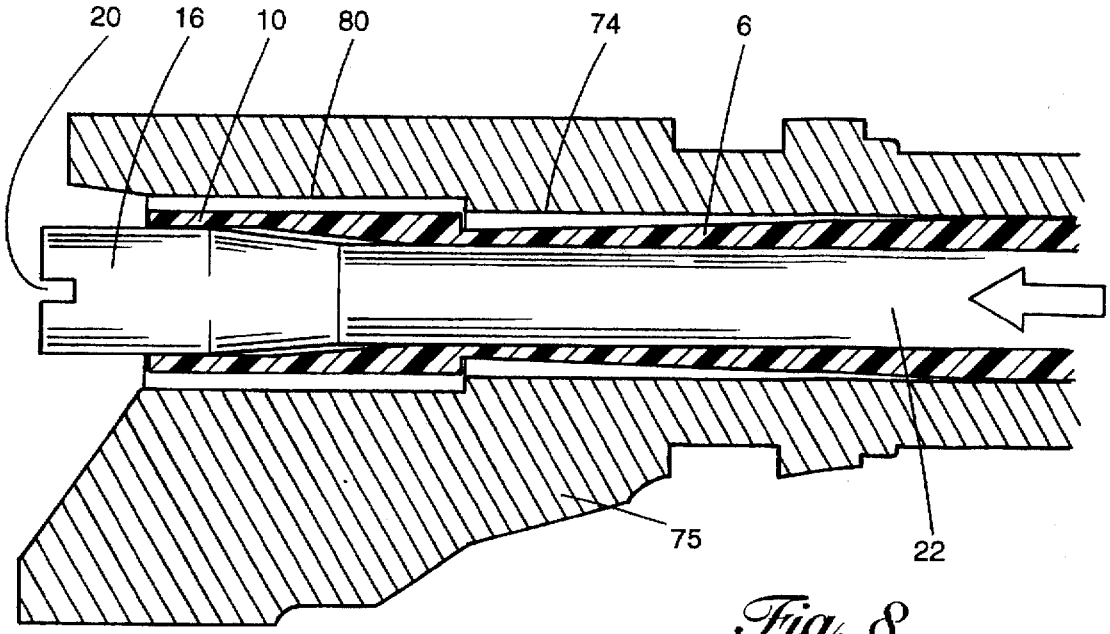
FIGS. 8 and 9 show the steps by which the barrel lock is reliably locked in place within (or removed from) the barrel of the hand gun.

Provided that there is no bullet remaining in the firing chamber of the hand gun 75, the barrel lock tube 6 will slide completely through the gun barrel 74 until the finger ledge 8 butts up against the barrel 74 (best shown in FIG. 7). With barrel lock tube 6 fully inserted in the gun barrel 74, the chamber lock 10 of tube 6 will snap into the relatively wide bullet chamber 80 (best shown in FIGS. 8 and 9) that is standard in the barrels of conventional hand guns. More particularly, as shown in FIG. 8, the chamber lock 10 will be maintained in its contracted, reduced diameter configuration with the expansion mandrel 16 displaced distally therefrom as the barrel lock tube 6 slides through the gun barrel 74. As soon as the chamber lock 10 reaches the existing bullet chamber 80, the compressive force applied to chamber lock 10 by the relatively narrow gun barrel 74 will cease and the coil springs 26 and 56, which have previously stored potential energy, will begin to expand.

In response to the expansion of springs 26 and 56, the barrel lock rod 22 is caused to slide proximally through the barrel lock tube 6, the lock shaft 30 is correspondingly driven proximally through the tumbler housing 40, and the barrel insertion knob 62 is pushed proximally and outwardly of housing 40. In this same regard, the expansion mandrel 16 is pulled by the barrel lock rod 22 proximally and inwardly of the chamber lock 10, whereby to generate a radial force for expanding chamber lock 10.

Figure 9:
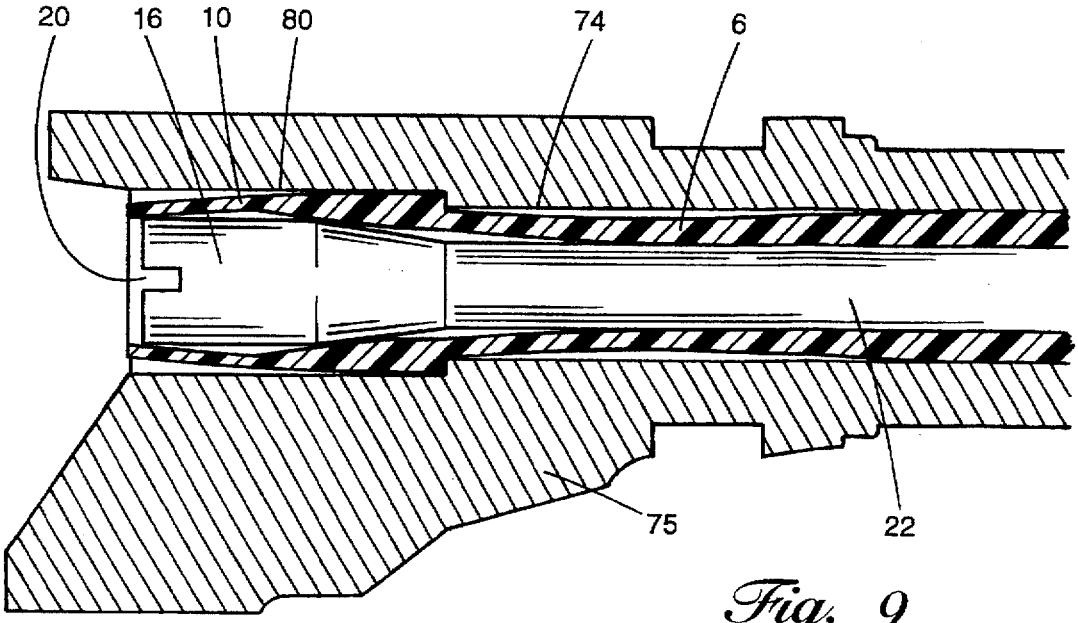

As is best shown in FIG. 9, the chamber lock 10 at the distal end of barrel lock tube 6 expands (i.e. snaps) into locking engagement with the bullet chamber 80 of the gun barrel 74. With the chamber lock 10 filling the bullet chamber 80, the hand gun 75 is rendered inoperable. The barrel lock 1 is now locked in place in the at-rest condition, such that the barrel lock tube 6 cannot be pulled out of the barrel 74 of hand gun 75 until an axial and distal pushing force is once again applied to the barrel insertion knob 62 and the expansion mandrel 16 is correspondingly displaced distally and outwardly from the chamber lock 10 (in the manner disclosed while referring to FIG. 5). Accordingly, the hand gun 75 cannot be fired so that it is now safe to be handled and stored.

To avoid the barrel insertion knob 62 from moving prematurely in response to the aforementioned pushing force and thereby prevent a removal of the barrel lock 1 by an unauthorized individual and the possible accidental firing of the hand gun 75, the tumbler wheels 42 are rotated out of the predetermined combination that is required to be dialed to activate barrel lock 1 from the at-rest condition to the insertion/removal condition. Therefore, the lock shaft 32 will be blocked from moving relative to the tumbler housing 40, and the barrel lock 1 is retained in the locked, at-rest condition.

To properly remove the barrel lock 1 from hand gun 75, the combination must first be successfully dialed in at the tumbler wheels 42 so as to free lock shaft 30 to be moved distally through tumbler housing 40 in response to an axial pushing force applied to barrel insertion knob 62. As in the case when the barrel lock 1 was first installed, the insertion knob 62 will move inwardly of the tumbler housing 40 which, in turn, causes the expansion mandrel to move distally and outwardly from the lock chamber 10 and permit the lock chamber 10 to automatically return to its normally contracted (i.e. reduced diameter) configuration out of locking engagement with the bullet chamber 80 (best shown in FIG. 8). With the axial pushing force maintained at barrel insertion knob 62 and the lock chamber 10 held out of engagement with the bullet chamber 80, the barrel lock tube 6 can now be pulled outwardly of and removed from the gun barrel 74.

The present invention is particularly advantageous in that the barrel lock 1 is adapted to fit any hand gun including semi-automatic and older wheel guns (e.g. western revolvers). In these cases, the length and diameter of the barrel lock tube 6 and lock chamber 10 may have to be adjusted depending upon the particular hand gun in which the barrel lock of the present invention will be inserted. Similarly, the barrel lock 1 of the present invention requires no alterations to a hand gun and does not depend upon a complicated coupling to or interaction with the trigger, firing pin, or the like.

It will be apparent that while a preferred embodiment of the invention has been shown and described, various modifications and changes may be made without departing from the true spirit and scope of the invention. Having thus set forth the preferred embodiment,

What is claimed is:

1. For a gun having a barrel and a bullet chamber communicating with the barrel for receiving a bullet to be fired through the barrel, a gun barrel lock to be removably inserted in the barrel and releasably retained at the bullet chamber to prevent the firing of the gun, said gun barrel lock comprising:

a barrel lock tube having proximal and distal ends and being sized to slide through the barrel of the gun;

a hollow chamber located at the distal end of said barrel lock tube to be received in and releasably retained at the bullet chamber when said barrel lock tube slides inwardly through the gun barrel so as to prevent a bullet from entering the bullet chamber, said hollow chamber manufactured from a flexible material having a spring like memory and adapted to expand from a relatively narrow size to a relatively wide size to fill the bullet chambers and thereby disable the gun;

a barrel lock rod surrounded by said barrel lock tube and having a proximal end, a distal end and expansion force generating means located at the distal end of said barrel lock rod, said barrel lock rod moving in a proximal direction relative to said barrel lock tube to locate said expansion force generating means within the hollow chamber of said barrel lock tube to cause said hollow chamber to expand to said relatively wide size in order to fill the bullet chamber and thereby prevent said barrel lock tube from sliding outwardly through the gun barrel, and said barrel lock rod moving in a distal direction relative to said barrel lock tube to remove said expansion force generating means from the hollow chamber of said barrel lock tube in order to allow said hollow chamber to contract to said relatively narrow size so that said barrel lock tube can slide outwardly through the gun barrel;

lock means having a moveable lock shaft that communicates with the proximal end of said barrel lock rod, said lock means being disposed in a locked condition to block the movement of said lock shaft whereby to prevent said barrel lock rod from moving in said distal direction relative to said barrel lock tube and said barrel lock tube from sliding outwardly through the gun barrel; and force transmitting means coupled to said barrel lock rod via the lock shaft of said lock means, said lock shaft being moved towards said barrel lock rod when said lock means is disposed in an unlocked condition and a distal pushing force is applied to said force transmitting means to cause said barrel lock rod to move in said distal direction relative to said barrel lock tube and permit said barrel lock tube to slide outwardly through the gun barrel.

2. The gun barrel lock recited in claim 1, wherein said lock means is a combination lock including a plurality of numbered tumbler wheels arranged in coaxial alignment with and rotatable around said lock shaft so that a combination can be dialed in, the rotational positions of said plurality of tumbler wheels relative to said lock shaft controlling the movement of said lock shaft towards said barrel lock rod in response to said distal pushing force applied to said force transmitting means.

3. The gun barrel lock recited in claim 2, further comprising a tumbler housing for receiving said plurality of numbered tumbler wheels and said lock shaft, such that said lock shaft is moveable in said tumbler housing and relative to said plurality of tumbler wheels when said tumbler wheels are rotated to match a particular predetermined combination, and said lock shaft is blocked from moving in said tumbler housing and relative to said plurality of tumbler wheels when said tumbler wheels do not match said particular predetermined combination.

4. The gun barrel lock recited in claim 3, wherein said proximal end of said barrel lock rod is axially aligned with said lock shaft within said tumbler housing and said barrel lock tube projects outwardly and distally from said tumbler lock housing.

5. The gun barrel lock recited in claim 3, wherein said force transmitting means is a knob that is connected to said lock shaft, such that said distal pushing force applied to said force transmitting knob is transferred to said lock shaft for causing said lock shaft to move in said tumbler housing towards said barrel lock rod and said barrel lock rod to move distally in said barrel lock tube so that said expansion force generating means is correspondingly pushed distally relative to and removed from said hollow chamber of said barrel lock tube.

6. The gun barrel lock recited in claim 5, wherein said tumbler housing has an entranceway formed therein for receiving said force transmitting knob at a manually accessible location, said force transmitting knob moving inwardly of said entranceway and into said tumbler housing in response to said distal pushing force applied thereto for causing said lock shaft to move towards said barrel lock rod and said barrel lock rod to move distally in said barrel lock tube.

7. The gun barrel lock recited in claim 6, further comprising a spring communicating with said force transmitting knob at the interior of said tumbler housing, said spring being compressed to store potential energy when said distal pushing force is applied to said force transmitting knob to move said knob inwardly of said entranceway in said tumbler housing, said spring expanding for driving said force transmitting knob outwardly of said entranceway when said distal pushing force is removed form said knob.

8. The gun barrel lock recited in claim 1, further comprising a region of said barrel lock tube surrounding said proximal end thereof to provide an indication of an obstruction in the bullet chamber of the barrel of the gun in the event that said barrel lock tube is blocked from sliding through the gun barrel for locating said hollow chamber in the bullet chamber.

* * * * *